United States Patent [19]

Witt

[11] Patent Number: 4,937,714

[45] Date of Patent: Jun. 26, 1990

[54] LIGHTING SYSTEM WITH HALOGEN BULB

[75] Inventor: Jürgen Witt, Hainburg, Fed. Rep. of Germany

[73] Assignee: W. C. Heraeus GmbH, Hanau, Fed. Rep. of Germany

[21] Appl. No.: 302,575

[22] Filed: Jan. 26, 1989

[30] Foreign Application Priority Data

Apr. 29, 1988 [DE] Fed. Rep. of Germany ..... 3814539

[51] Int. Cl.[5] ..... F21M 1/00

[52] U.S. Cl. ..... 362/255; 362/293; 362/294; 362/804

[58] Field of Search ..... 362/61, 80, 293, 255, 362/804

[56] References Cited

U.S. PATENT DOCUMENTS

| | | | |
|---|---|---|---|
| 1,822,076 | 9/1931 | Bauersfeld et al. | 362/804 |
| 2,852,980 | 9/1958 | Schroder | 362/293 |
| 3,174,067 | 3/1965 | Bahrs | 362/293 |
| 3,255,342 | 6/1966 | Seitz et al. | 362/293 |
| 3,463,914 | 8/1969 | Lutter | 362/293 |
| 4,161,014 | 7/1979 | Dey et al. | 362/293 |
| 4,254,455 | 3/1981 | Neal, Jr. | 362/804 |
| 4,380,794 | 4/1983 | Lawson | 362/804 |
| 4,663,557 | 5/1987 | Martin, Jr. et al. | 362/293 |
| 4,766,526 | 8/1988 | Morimoto et al. | 362/255 |

*Primary Examiner*—Ira S. Lazarus
*Assistant Examiner*—Sue Hagarman
*Attorney, Agent, or Firm*—Felfe & Lynch

[57] ABSTRACT

A lighting system, including a light source having a light bulb and a reflector, has an interference filter applied to a portion of the outer surface of the light bulb. The interference filter has a high transparency for visible light and a high reflectivity for infrared radiation. The area of the light bulb that is permeable to infrared radiation is adjacent to an area of the reflector which is made to be infrared-radiation transmitting.

10 Claims, 1 Drawing Sheet

LIGHTING SYSTEM WITH HALOGEN BULB

BACKGROUND OF THE INVENTION

The invention relates to a lighting system with a light source provided with a light bulb and with a reflector associated with the light source, in which an interference filter having a plurality of layers is provided on at least a portion of the outside surface of the light bulb and has a high reflectivity for infrared radiation.

It is known to use halogen incandescent lamps in different optical systems, such as, for example, studio lighting and operation-room lighting, or daylight film projectors, in which as little as possible of the infrared radiation content of the light is to issue in the direction of projection, in order to reduce thermal radiation in the illuminated field. This is accomplished as a rule by reflectors which transmit infrared radiation and reflect visible light and/or by filters at the openings at which the light emerges, which absorb much of the infrared radiation content.

DE-OS 32 27 096 discloses a cylindrical halogen incandescent lamp with an incandescent coiled filament held along the axis of the cylinder of the light bulb, in which the light bulb is coated on its exterior with a multi-layer body acting as an interference filter which reflects the infrared radiation content of the light produced in the lamp onto the coil, while it transmits the visible content of the produced light. The interference filter has layers of alternately high and low index of refraction, the materials of these layers consisting substantially of silicon dioxide and tantalum pentoxide. If the filament is sufficiently well adjusted along the axis of symmetry of the lamp bulb, the reflected infrared radiation is partially absorbed by the filament. In this manner the amount of transmitted infrared radiation is reduced, thereby improving the efficiency of the lamp.

A similar arrangement is disclosed in U.S. Pat. No. 4,689,519, according to which an incandescent lamp is provided in the cylindrical central portion of its elongated lamp bulb with an interference filter which reflects the infrared radiation produced by the filament to reduce heat losses in the lamp bulb; the filter consists of alternately disposed layers of low and high refractive index, these layers consisting of silicon dioxide and tantalum pentoxide; the two bulb ends are not coated with tantalum pentoxide, because reflection of infrared light onto the filament from these ends is ineffective.

Furthermore, DE-OS 15 89 095 discloses gas discharge lamps whose bulbs are provided with an optical interference filter of several partial layers of different refractive index for the purpose of producing a heat-resistant filter system for the production of neutral-color light.

Another application of interference filters is disclosed in DE-GM 18 09 322, in which a cold-light mirror transparent to heat rays is described, whose surface is covered with a series of interfering dielectric layers of alternately high and low refraction; silicon oxide and titanium oxide or tantalum oxide are used as the materials of the layers.

In the case of halogen incandescent lamps of relatively small dimensions it is not possible to absorb the infrared radiation in the filament by reflecting the infrared content onto an interference filter applied to the bulb, since the axis of symmetry of the filament does not, as a rule, coincide with the axis of symmetry of the lamp bulb, and in common forms of construction (e.g., bulbs with a base on one end) it is perpendicular thereto.

If nevertheless the bulb were to be coated with an interference filter it would result in multiple reflection which, however, due to the partial transmittance of the interference coating, would ultimately result in the transmission of the infrared radiation. Reduction of the infrared content would be practically unachievable.

The invention proposes to achieve a very simple shielding of the illuminated field against infrared radiation by geometrical coordination of the light source and the reflector, as well as by partially coating the outer surface of the bulb of the light source, wherein lamp and reflector are relatively inexpensive in spite of their excellent effectiveness.

One preferred embodiment is a halogen incandescent lamp with a base at one end, in which the lamp is so coated that infrared radiation issues from the base area or from the area of the dome of the light bulb or in both areas.

An advantage proves to be the elimination of the filter and filter holder, so that a relatively simple construction is the result, requiring no skilled maintenance. This is advantageous in the case of operating-room lighting with a plurality of individual light sources. Furthermore, the stocking of replacements is simplified, since separate infrared radiation absorbing filters are no longer necessary.

SUMMARY OF THE INVENTION

In accordance with the invention, a lighting system comprises a light source having a light bulb and a reflector associated with the light source. The system includes an interference filter including several layers applied to at least a portion of the outer surface of the light bulb and having a high transparency for visible light and a high reflectivity for infrared rays. The light bulb has an area transparent only to visible light and an area transparent to infrared rays. The light bulb area transparent to visible light is provided with the interference filter. The light bulb area transparent to infrared rays is adjacent to an area of the reflector which is infrared ray transmitting.

For a better understanding of the invention, together with other and further objects thereof, reference is made to the following description, taken in connection with the accompanying drawings, and its scope will be pointed out in the appended claims.

BRIEF DESCRIPTION OF THE DRAWING

Referring now to the drawing.

DESCRIPTION OF A PREFERRED EMBODIMENT

Figure 1A:
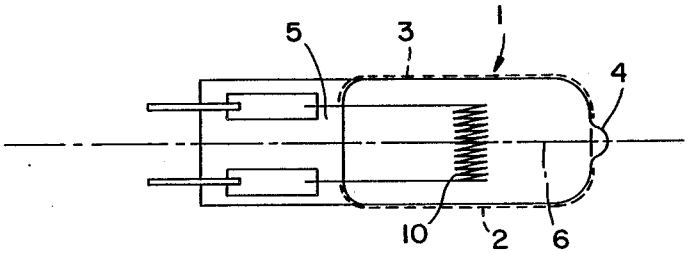
FIG. 1*a* is a longitudinal section of a halogen incandescent lamp in accordance with the invention.

In accordance with FIG. 1*a*, the halogen incandescent lamp with a base at one end preferably is a cylindrically symmetrical light bulb 1 whose sides 2 are provided with an interference coating 3 on the cylindrical periphery. The interference coating preferably has layers of alternately high and low refractive index, the infrared content of the light produced in the lamp being reflected into the interior of the light bulb. The coating disclosed in DE-OS 32 27 096, for example, can serve as the interference coating; outside of the actually cylindrical periphery, i.e., in the area of the dome of the bulb and in the base area 5 the bulb has no interference coating and thus is transparent to infrared radiation. The infrared radiation produced in the lamp and reflected by the interference coating into the bulb passes out along the cylinder axis 6 of the light bulb 1 at a solid angle $\alpha$. The solid angle $\alpha$ ranges from 20 to 160 degrees.

Figure 1B:
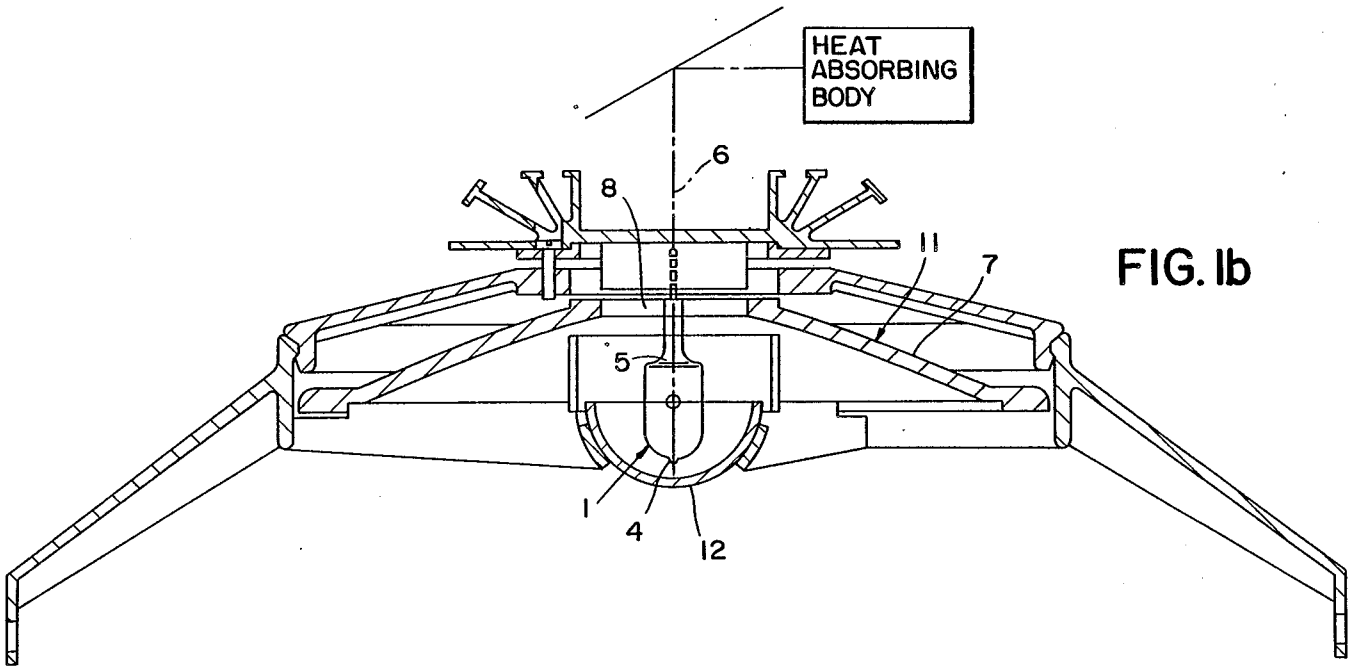
FIG. 1*b* represents a longitudinal section taken through an operating room light.

In accordance with FIG. 1*b*, the visible light radiating through the interference coating 3 is transmitted in part directly and reflected in part through the reversing mirror 12 onto the reflector 7 by which it is reflected onto the actual illuminated field; the infrared radiation, however, exits through the uncoated base area 5 of the light bulb 1; it is carried out of the optical system through the opening 8 in the reflector system 11, i.e., through the infrared light transmitting part of the reflector system 11, and falls directly or indirectly onto heat-absorbing bodies which are not represented in FIG. 1*b* to avoid obstructing the view of the latter. In the case of indirect irradiation of the heat-absorbing bodies, the infrared radiation is reflected by reversing mirrors to the heat-absorbing bodies. It is, of course, also possible to dispose the light bulb by turning it 180 degrees such that the area of the dome 4 of the light bulb 1 will be adjacent the opening 8 in the reflector system 11, i.e., the portion that transmits infrared radiation.

It is furthermore also possible to use light bulbs which are transparent to infrared radiation both in the area of the dome 4 and in the area of the base 5; in such a case, as seen in FIG. 1*b*, the infrared radiation issuing from the dome 4 is guided by reversing mirror 12 along the axis 6 of the light bulb into the opening 8 in the reflector system 11, i.e., to the infrared radiation transmitting part of the reflector system.

During operation, rays of visible light pass out radially (to the cylinder axis 6) with maximum intensity, while in the axial direction rays of infrared radiation issue at maximum intensity. Thus, the lamp in accordance with the invention brings about a separation of the directions in which visible light and infrared radiation are emitted.

If the optical system surrounding the lamp is so designed that only the filament of the lamp is imaged in the field of illumination, the field of illumination is virtually free of undesirable thermal radiation.

The embodiment has been explained in conjunction with a halogen incandescent lamp; it is also possible, however, to use instead of the halogen incandescent lamp a gas discharge lamp with a light bulb whose outer surface is provided with an interference filter which surrounds the discharge length of the lamp.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Operating light comprising: a light source which has a bulb and a reflector system associated with the light source, including areas which at least one of absorb and transmit infrared radiation, and an interference filter which includes several layers applied to the external surface of the bulb and which has a high transparency for visible light and a high reflectivity for infrared radiation, and the bulb having an area transparent for infrared radiation and the bulb being oriented inside the reflector system such that the area of the bulb which is transparent for infrared radiation is associated with those areas of the reflector system which at least one of absorb and transmit infrared radiation.

2. Operating light comprising: a light source which has a bulb and a reflector system associated with the light source, including areas which at least one of absorb and transmit infrared radiation, and an interference filter which includes several layers applied to the external surface of the bulb and which has a high transparency for visible light and a high reflectivity for infrared radiation and includes a reversing mirror, the reflecting surface of which facing toward the areas of the reflector system which at least one of absorb and transmit the infrared radiation, and the bulb having an area transparent for infrared radiation, and the bulb being inside the reflector system and the reversing mirror being oriented such that the area of the bulb which is transparent for infrared radiation is associated with the reversing mirror which directs the infrared radiation to an area of the reflector system which at least one of absorbs and transmits the infrared radiation.

3. Operating light in accordance with claim 1, in which the bulb has an additional area transparent for infrared radiation which is opposite the first-mentioned transparent area, and which includes a reversing mirror, the reflecting surface of which facing toward the areas of the reflector system which at least one of absorb and transmit the infrared radiation, the additional area of the bulb being associated with the reversing mirror.

4. Operating light in accordance with claim 1, in which the transmitting area of the reflector system is configured as a continuous opening.

5. Operating light in accordance with claim 1, in which the interference filter basically consists of silicon dioxide and tantalum pentoxide layers.

6. Operating light in accordance with claim 1, in which the light source comprises a halogen incandescent lamp which has a base on one side and in which the bulb thereof encloses a spiral incandescent filament and the spiral filament is enclosed by the interference filter layers.

7. Operating light in accordance with claim 6, in which the light bulb is of axis-symmetrical configuration at least in the area from which the light issues.

8. Operating light in accordance with claim 7, in which the interference filter is a cylindrical jacket on a light bulb which is cylindrically configured at least in that area from which the light issues.

9. Operating light in accordance with claim 7, in which the infrared light transmitting area of the reflector system is intersected by an axis of the light bulb.

10. Operating light in accordance with claim 9, in which the infrared radiation is issued at a solid angle of 20° to 160° along the cylindrical axis of the light bulb.

* * * * *